US005734693A

United States Patent [19]

Quint et al.

[11] Patent Number: 5,734,693

[45] Date of Patent: Mar. 31, 1998

[54] RADIATION EXPOSURE SYSTEM

[75] Inventors: Arthur S. Quint, Beverly Hills; Daniel J. Giesberg, Los Angeles, both of Calif.

[73] Assignee: American Medical Sales, Inc., Hawthorne, Calif.

[21] Appl. No.: 725,067

[22] Filed: Oct. 2, 1996

[51] Int. Cl.[6] ..... G21K 3/00

[52] U.S. Cl. ..... 378/185; 378/158; 378/159

[58] Field of Search ..... 378/38, 39, 40, 378/156, 158, 159, 168, 169, 182, 185

[56] References Cited

U.S. PATENT DOCUMENTS

| | | | |
|---|---|---|---|
| 2,506,342 | 5/1950 | Burke | 378/159 X |
| 3,499,150 | 3/1970 | Tajima et al. | 378/185 X |
| 4,082,957 | 4/1978 | Morlan | 378/159 X |
| 4,641,336 | 2/1987 | Gastrin | 378/159 X |
| 4,772,803 | 9/1988 | Horiuchi et al. | 378/185 X |
| 5,282,254 | 1/1994 | Chiu et al. | 378/159 X |

OTHER PUBLICATIONS

Product Information Sheet from Dr. Goos-Suprema, "*X-Ray Intensifying Screens*" no date.

Achieving improved visualization of the temporomandibular joint condyle and fossa in the sagittal cephalogram and a pilot study of their relationships in habital occlusion, "Stanley Braun, DDS, MME, *American Journal of Orthodontics and Dentofacial Orthopedics*," Jun. 1996 pp. 635-638.

"A dual sensitivity screen system for TMJ image enhancement in cephalometric radiography: Sensitometric evaluation," Wakoh, et al.: *Angle Orthod*, dated Dec. 6, 1993.

*Primary Examiner*—David P. Porta

*Attorney, Agent, or Firm*—Merchant, Gould, Smith, Edell, Welter & Schmidt

[57] ABSTRACT

A system of radiography includes the provision of a cassette which is to be subjected to exposure from radiation beam. The cassette includes a screen layer and a filter layer having regions of different optical density and an imaging film. The filter acts to reduce the exposure of the film to the effect of radiation. The cassette is useful for dental images, particularly of the temporamandibular joint.

33 Claims, 2 Drawing Sheets

RADIATION EXPOSURE SYSTEM

BACKGROUND

Providing a system that permits films reacting to a radiation imaging process to be exposed at discreet intensities for different portions of a subject is valuable. This is especially important for living subjects, namely humans, and more particularly where the image is of the dental structure of humans where the density of the human bone structure and tissue varies considerably.

This invention relates to a radiographic system, particularly an x-ray exposure system, for use in dental radiography. The invention is particularly directed to facilitating effective radiography of the temporamandibular joint (TMJ).

It is known to be particularly difficult to attempt to visualize the temporamandibular joint and adjacent structures of the jaw. Different techniques have evolved over time to try to improve this system.

One known technique for doing this is the provision of a screen which lies adjacent to a film which has a central circular area comprised of a high speed reactant material. The remaining outer portion of this screen is a different speed reactant material. The different speeds of the screen are rated to emit different amount of visible light than conventional medium speed screens.

When this dual sensitivity screen is used as a screen in lateral cephalometric radiography, the inner part of the screen approximates the area where the TMJ, external auditory meatus, and posterior cranial base are imaged. These structures, especially the TMJ, are among the most difficult to visualize in lateral cephalometric radiographs. The difficulty is principally due to the superimposition of the petrous portion of the temporal bone.

The use of the dual sensitivity screen in lateral cephalometric films has allowed greater energy conversion efficiency in a region of increased attenuation. This also results in greater image clarity. On the other hand there is a reduction in the image quality particularly in sharpness and resolution.

While intensifying screens are employed in cephalometric radiography, there are significant difficulties in obtaining images of particular subjects and particular structures in subjects.

The particular reactant material which compose the screen determine the wave-length of light emitted when the screen is irradiated. Calcium tungstate and barium strontium sulfate emit light in the blue and ultra violet regions of the spectrum. This corresponds to the range of visible light to which conventional silver halide films are most sensitive. Other phosphors are derived from the rare-earth elements of lanthanide series. The use of rare-earth phosphor screens necessitate that films used with these intensifying screen systems is sensitive to higher wavelengths of light.

There is a need to match the spectral sensitivity of screens with the appropriate film so as to optimize image quality and further minimize radiation exposure to the patient. This does not necessarily or easily permit for effective visualization of the desired areas being radiated.

The present systems and methods have considerable disadvantages and difficulties in use.

SUMMARY

By this invention there is provided a radiographic imaging system that includes a cassette, a screen or screens, film and method for affecting the radiation effecting the light emitting screens and the light emitted by the screens that are activated by the radiation source which minimizes the disadvantages of prior systems.

According to the invention there is provided a radiographic system which uses an arrangement, preferably as a cassette, which in overlaying relationship provides a screen layer, film and a filter layer.

The overlaid relationship defines an area for exposure to a radiation beam derived from a radiation source. The screen layer is a material that emits light when exposed to a radiation source. After being exposed to radiation, the reactant materials of the screen are activated to cause the film to record an image approximating the structure through which the radiation has passed. A screen layer can be used adjacent to one or both sides of the film.

The filter layer has an area of first optical density and an area of a second optical density. The filter is used for reducing the exposure of the film to the effect of radiation. The spectral responses of the filter are selected to conform with the nature of the film.

This multiple optical density filter effectively results in having the radiation beam react with the screens differently. This multiple optical density filter also effectively results in having the screens react with the film differently. It modifies and improves the image on the x-ray film differently and discreetly in accordance with the location of the filter's different optical density regions.

The filter has the second area of different density in a predetermined location so that the cassette can be aligned in a location relative to the subject. As a result, the portion of the film corresponding to the desired structure of the subject is exposed differently than the remainder of the film. The remainder portion of the film is exposed to the radiation in accordance with the second optical density of the filter.

Preferably, the second optical density is formed as a circular cutout in the central portion of the filter.

In one preferred form, the material constituting the filter is a layer which absorbs energy in the wavelength spectrum of preferably at least one of the green and blue. As such the material is a relatively green-blue colored material. The film is a conforming film, namely, a blue light or green light sensitive film.

In a further preferred form of the invention at least one of the screen layers is provided with different amounts of reactant material. Preferably there is a graduated screen where the reactant material varies over its surface. This can be from one end of the screen towards the opposite end of the screen.

Orthodontists, general dentists doing orthodontics, oral surgeons taking lateral cephalometric films, dental radiologists, and other professionals interested in issues affecting the TMJ have found it difficult, if not impossible, to make a TMJ screening with a conventional lateral cephalometric film.

An object of this invention is to provide a process to minimize difficulties and, at the same time produce an image with additional relevant information.

With the invention, the clinician has the opportunity of having a screening process to visualize the TMJ for any gross pathology.

The invention is described further with reference to the accompanying drawings.

DRAWINGS

DESCRIPTION

Figure 1:
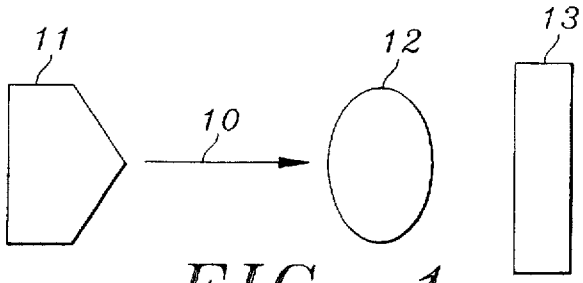
FIG. 1 is diagramatic view of a typical imaging set up.

The radiography apparatus comprises different elements in overlapping relationship so as to define an area for exposure to a radiation beam 10 generated from a radiation source 11. The beam radiates a subject 12, such as a human subject, and then is directed to a cassette 13 containing the various elements.

In the cassette 13 there is a screen layer 14, a radiation recording element in the nature of a film 15 for recording a radiation image caused by the beam 10 directed to the subject 12, and a filter layer 16. The cassette includes a back face 17, an inside body 18 for housing the layers 14, 15 and 16, and a front face 19 through which the radiation is directed.

The filter layer 16 has an area 20 of first optical density and an area 21 of second optical density. The filter layer 16 acts to regulate the effect of the exposure of the film 15 from the light emitted from the screen 14 and 22. The filter layer 16 also acts to regulate the effect of the exposure of the screen 22 to the radiation beam 10 on to the radiation recording film 15. As such, the filter 16 may be a partially radiation opaque, absorbing or blocking material.

In the filter layer 16 the area 20 of first optical density includes a first material. The area 21 of second optical density may be a material of differing optical density or an aperture in the material. The area 21 of second optical density is substantially a circular cutout in the layer. The circular cutout is substantially centrally located in the area of the filter layer 16 so that it may be located over a particular area of interest when the image is taken.

The filter layer 16 is a material for minimizing passage of rays in the wave-length spectrum range of at least one of blue or green, selectively to inhibit the passage of wavelengths in the range of about 440 nm to about 580 nm. This is where the film 15 is of a blue and/or green nature. The material is known as "deep dye polyester color filters", "color control materials", "photographic light gels," and other similar terms and is conventionally for use in the photographic industry for light filtering.

When the film 15 is of a red nature the filter layer 16 is of a different spectral nature and blocks rays at a different wavelength, namely about 580 nm to 700 nm. Other combination of film and filter could be used with ranges for many different visual or invisible light ranges.

Figure 2:
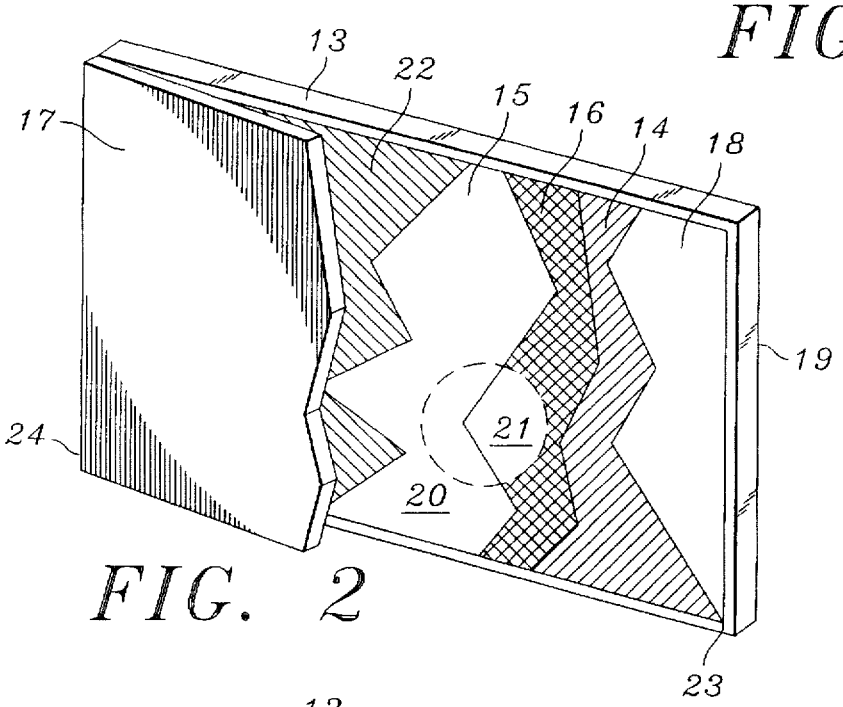
FIG. 2 is a perspective view with parts broken away, of a cassette set up for double emulsion films.

As illustrated in FIG. 2, there can be at least two screen layers 14 and 22, with the filter layer 16 located between the screen layers 14 and 22. At least one of the screen layers 14 or 22 includes an area of different amounts of reactant material. The area of different amounts of reactant material is selectively graduated from a first end 23 of a screen 14 or 22 to a second opposite end 24 of a screen 14 or 22.

In an alternative form, the first screen 14 can be of substantially constant amounts of reactant material and the second screen 22 can be of a varying amounts of reactant material. The screen layer 14 or 22 could be graduated in optical density substantially regularly or linearly from the first end 23 toward a second opposite end 24 of the layer 14 or 22.

The invented method uses the filter 16 so that the optical densities are related to the subject 12 for radiation. Thus radiation is directed for recordal on the film 15 is such that the subject 12 for radiation is relatively aligned with the film 15 and the filter 16. In this manner a predetermined image of the subject is obtained on the film 15. The image obtained is coordinated with the portion of the selected densities of the filter 16.

Figure 3:
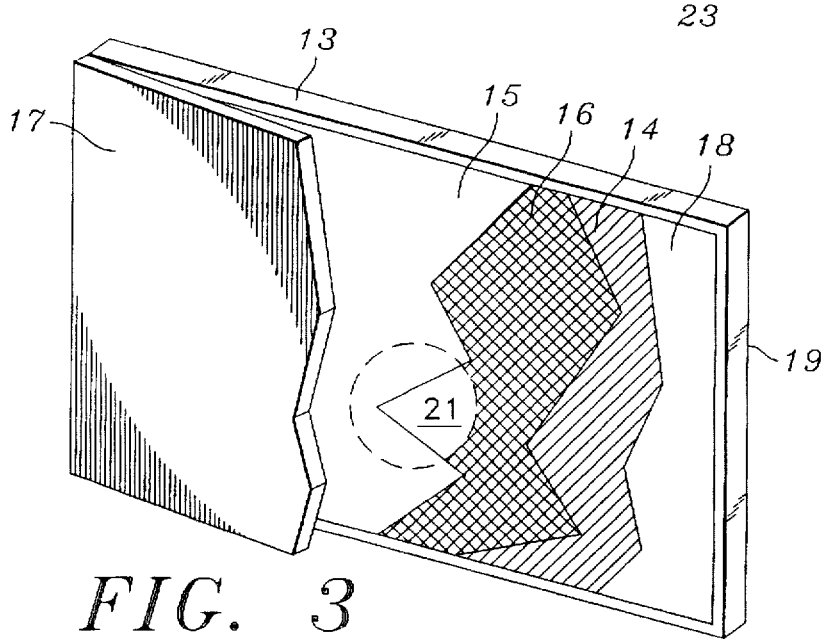
FIG. 3 is a perspective view, with parts broken away, of a cassette set up for a single emulsion film.

As shown in FIGS. 2 and 3, the film is housed in the cassette 13 which is a lightproof container. To reduce radiation dosage, the film is sandwiched between two "screens" that fluoresce or phosphoresce when they are exposed to radiation. It is the light created by the radiation beam 10 and coming from the screens 14 and/or 22 that exposes the film 15.

Two screens 14 and 22 are used for films 15 having two emulsion sides. One screen 14 is used for films 15 with only one emulsion side. It is also possible to use the one screen 22 for film 15 with only one emulsion side. In most cases, the screen must be adjacent to the emulsion side of the film. The film 15 is then developed to reveal the latent image created by the exposure.

The invented process as applied to dental radiation provides for achieving an effective imaging through radiation of three distinct regions:

1. Creating the lateral cephalometric view.
2. Visualizing of the soft tissue areas of the head.
3. Visualizing of the TMJ region, external auditory meatus, posterior cranial base, and glendoid fossa.

Figure 4:
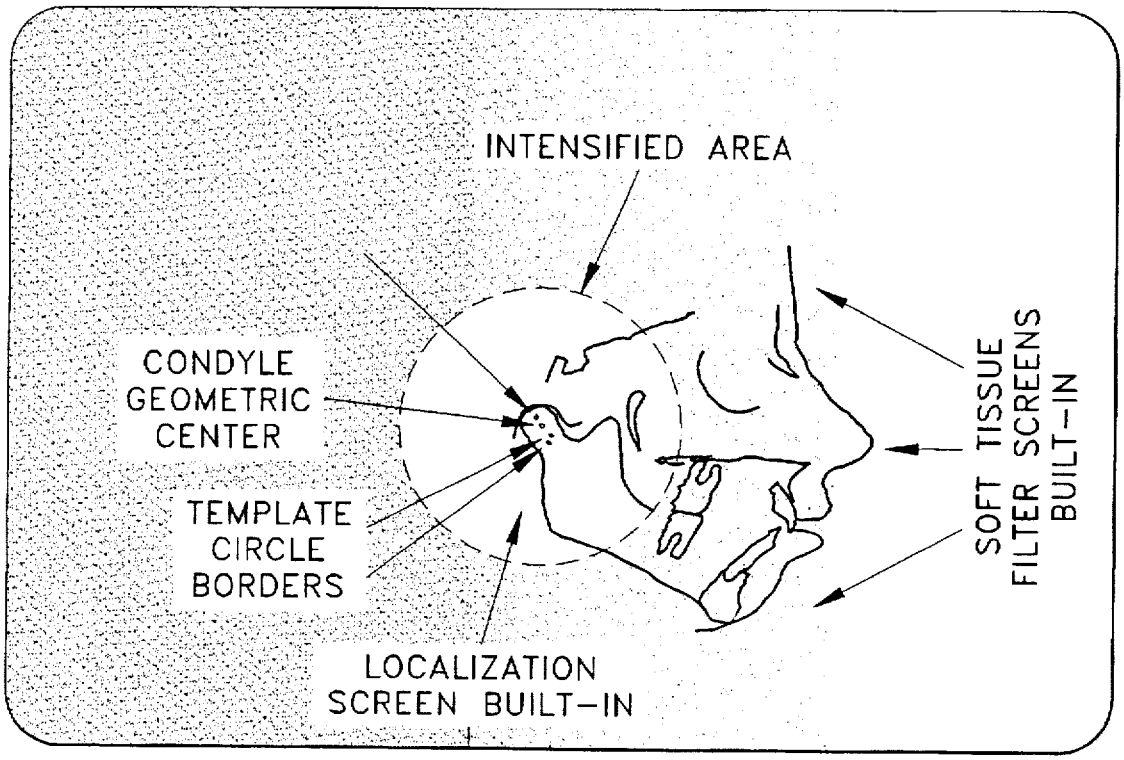
FIG. 4 is a representation of a typical film resulting from the radiation processors applied to a dental exposure of the TMJ.
Figure 5:
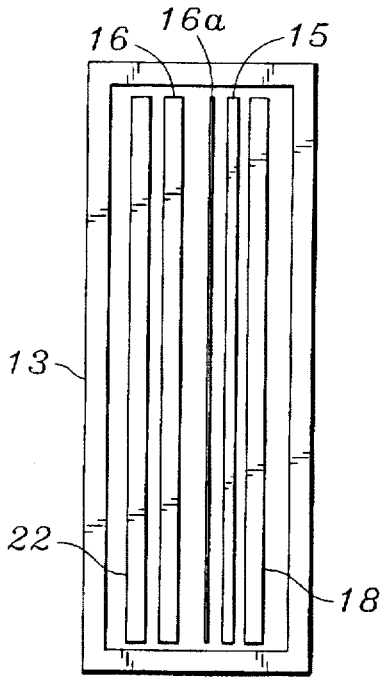
FIG. 5 is an embodiment illustrating multiple screens and multiple filters.

As can be seen in FIG. 4, the graduated screen 14 and/or 22 affect, together with the filter 16 having the different spectral densities, permits for effective imaging. The intensified area conforms to the portion 21 with the differing optical density.

Generally, the invented system uses a combination of a regularly or graduated exposure screen or screens together with a method of obtaining a differential exposure rate, as produced by the filter which has an appropriate matching spectral response in relation to the film and the nature of the subject being irradiated. This produces the desired image result, particularly in dental imaging of the TMJ.

When the clinician uses the system of the invention and takes a "conventional" lateral cephalometric film, the clinician sees standard landmarks on the film as before. In addition the clinician has the additional information of a screening of the TMJ as well as adjacent areas such as the external auditory meatus and the posterior cranial base. By adding a graduated screen, clinician also obtains a view of the soft tissue of the nose and chin area.

Previously these areas could not be seen on the "conventional" lateral cephalometric film due to the fact that these soft tissue areas would be overexposed. The soft tissue areas are important areas to see because their appearance on the film allow the clinician to make important measurements related to such points as Potion, Frankfurt Plane, etc.

With the prior art if all these areas are of interest to a professional, numerous medical films and procedures would be required to obtain the information made available on a film using the invention. These multiple films expose the patient to unnecessary levels of radiation, and require the professional to develop a diagnosis or medical supposition from several non-correlated radiographs.

The invention provides a screening process for visualization of the TMJ, external auditory meatus, posterior cranial base, and a visualization of the soft tissue of the nose and chin.

Equally important, the use of the invention produces a single image that may provide the professional with all the necessary information required, while exposing the patient to a single radiation exposure, at no higher level than is required for a single conventional lateral cephalometric film that does not provide this information. There are many ways to produce the effective imaging effect. This can be effected on the screen or otherwise created with the filter.

These different techniques include:

1. A graduated screen or screens.
2. A graduated optical filter or filters within the cassette, screen, film package.
3. A printed, silk screened or other method of placing light absorbing or blocking substances onto at least a portion of at least one of the screen or screens.
4. A graduated radiation absorbing material between the x-ray source and the cassette. These can include a filter or filters at the x-ray beam source, a filter or filters near the patient's head, graduated "grid" or "grids" between the patient and the cassette, graduated radiation absorbing or blocking material on the surface of the cassette.
5. Combining two or more different rated screens.
6. Using a single screen in only one portion of the cassette.
7. Placing an optical density filter or filters over a portion of one or more of the screens.

Many variations of the invention are possible each differing from the other in matters of detail only.

For instance, instead of using the system with x-ray radiation there could be applications with other radiation sources, such as gamma-ray sources.

Instead of having the filter in a cassette it is possible to locate the filter in any other suitable position between the beam source and the cassette which contains the screen and the film. Thus the filter can be immediately downstream from the source and ahead of the subject for imaging, or alternatively downstream from the subject, or more particularly on the outside of the cassette.

In yet a different form the second optical density is provided with an area which is not a cut out, but is an area responsive to different wave-lengths. Thus, the second cut out region may be to block only blue wave-length light, whereas the first optical density is to block green and blue. In other forms, the second density area can have other non-circular profiles, according to the required image, and the subject being radiated.

Further different characteristics of the filter are possible. Thus while the filter is described as inhibiting blue and green wavelengths, it may be possible to be effective if just one or other of the wavelengths in that spectrum of the color range are inhibited or in entirely different wavelengths in the visible or invisible spectrum. More than one area of different optical density can be provided in the filter. Thus the filter can be designed with multiple different optical characteristics. Further, there can be multiple filters 16 and 16*a*, and these can be arranged appropriately in relation to the screens 18 and 22 and film 15.

In different forms, one or more of the screens can have multiple different discreet areas of reactant material. For instance, this could be top to bottom, middle to one or more ends or other combinations.

In further embodiments of the invention, the mechanical film 16 can be replaced in part or whole by an electronic and/or chemical filter. Such a filter would be, for example, a liquid crystal similar to those used in electronic displays. Different dyes that are either radiation absorbing or light spectrum blocking can be used in such a filter. These are arranged in discreet locations according to the desired use.

In yet other forms of the system the image recordal medium can be different to a film 15. Thus the medium could be a digital or chemical receptor. These transfer the recorded image, as a result of a directed energy beam in either analog or digital form. This information can be displayed on a device such as a CRT or recorded through the use of a printer or film processor.

The electronic and/or chemical filter can be used together with the digital or chemical receptor.

Further, although the invention has been described mainly with regard to dental x-ray radiation it is clear that there are applications beyond that, and beyond radiation of the human or other living subject.

The invention is to be determined solely in terms of the following claims.

We claim:

1. A radiography apparatus having in overlapping relationship so as to define an area for exposure to a radiation beam, the apparatus comprising:

a screen layer having areas of different reactance, a radiation recording element for recording a radiation image caused by a beam directed to a subject, and a filter layer, the filter layer having an area of first optical density and an area of second optical density, the filter layer being for regulating the effect of the exposure of the screen layer to a radiation beam over a selected area of the screen layer and the radiation recording element.

2. Apparatus as claimed in claim 1 including at least two screen layers, and wherein the filter layer is located between the screen layers.

3. Apparatus as claimed in claim 1 wherein the layer relationship in the direction from a source of the radiation beam includes the screen layer, the filter layer, and the radiation recording element.

4. Apparatus as claimed in claim 2 wherein the layer relationship in a direction from the radiation beam includes the screen layer, the filter layer, a radiation recording element and the second screen layer.

5. Apparatus as claimed in claim 1 wherein the screen layer includes areas of different reactant material, the areas of different reactant material selectively being graduated across the surface of the screen layer.

6. Apparatus as claimed in claim 2 wherein the screen layers include areas of different reactant materials, each screen layer being selectively graduated with varying reactant materials across the surface of the screen layer.

7. Apparatus as claimed in claim 2 wherein a first screen is of substantially consistent reactant material and a second screen is of a varying reactant material.

8. Apparatus as claimed in claim 1 wherein the filter layer includes an area of first optical density formed by a first material, and wherein the area of second optical density is an aperture in the material.

9. Apparatus as claimed in claim 2 wherein the filter layer includes an area of first optical density formed by a first material, and wherein the area of second optical density is an aperture in the material.

10. Apparatus as claimed in claim 1 wherein the area of second optical density is substantially a circular cutout in the filter layer, the circular cutout being substantially centrally located in the area of the filter layer.

11. Apparatus as claimed in claim 2 wherein the area of second optical density is substantially a circular cutout in the filter layer, the circular cutout being substantially centrally located in the area of the filter layer.

12. Apparatus as claimed in claim 8 wherein the screen layer is graduated in reactant material substantially regularly from a first end toward a second opposite end of the screen layer.

13. Apparatus as claimed in claim 10 wherein the screen layer is graduated in reactant material substantially regularly from a first end toward a second opposite end of the screen layer.

14. Apparatus as claimed in claim 1 wherein in a direction from the radiation beam the relationship of the layers is a radiation recording element, the filter layer and the screen layer.

15. Apparatus as claimed in claim 1 for use in dental radiography, and selectively for use in affecting radiation directed towards the temporamandibular joint, the radiation beam being an x-ray beam and the recording element being an x-ray film.

16. Apparatus as claimed in claim 2 for use in dental radiography, and selectively for use in effecting radiation directed towards of the temporamandibular joint, the radiation beam being an x-ray beam and the recording element being an x-ray film.

17. Apparatus as claimed in claim 1 for use in effecting radiation directed towards of a living subject, the radiation beam being an x-ray beam and the recording element being an x-ray film.

18. Apparatus as claimed in claim 2 for use in effecting radiation directed towards of a living subject, the radiation beam being an x-ray beam and the recording element being an x-ray film.

19. Apparatus as claimed in claim 1 wherein the filter layer is a material for minimizing passage of light in the wavelength spectrum range of at least one of blue or green, selectively to inhibit the passage of wavelengths in the range of about 440 nm to about 580 nm.

20. A radiography cassette comprising, in overlapping relationship so as to define an area for exposure to a radiation beam, a screen layer having areas of different reactance, a film for recording an image caused by a radiation beam passing through a subject, and a filter layer, the filter layer having an area of first optical density and an area of second optical density, the filter layer being for regulating the spectral response of the screen layer to radiation from a radiation beam over a selected area of the screen layer and the film.

21. A cassette as claimed in claim 20 including at least two screen layers, and wherein the filter layer is located between the screen layers.

22. A cassette as claimed in claim 21 wherein the screen layer includes areas of different amounts of reactant material that vary across the surface of the screen layer.

23. A cassette as claimed in claim 20 wherein the filter layer includes the area of first optical density having a first material, and wherein the area of second optical density is an aperture in the material.

24. A cassette as claimed in claim 20 wherein the area of second optical density is substantially a circular cutout in the filter layer, the circular cutout being substantially centrally located in the area of the filter layer.

25. A cassette as claimed in claim 23 wherein the screen layer is of reactant material that varies across the surface of the screen layer.

26. A cassette as claimed in claim 23 wherein the filter layer is a material for minimizing passage of lightwaves in the wavelength spectrum range that is substantially matched to the film.

27. A method of imaging a subject comprising the steps of locating a subject between a radiation beam and a cassette, the cassette including an overlaid relationship of at least one screen layer having areas of different reactance, at least one filter layer having at least an area of first optical density and an area of second optical density, and a radiation recording element for recording an image of the subject caused by the beam passing through the subject, the at least one filter layer being for regulating the effect of the exposure of the at least one screen layer to the radiation beam over a selected area of the radiation recording element, and wherein the sequence of the overlaid relationship of the at least one filter layer, the at least one screen layer and the at least one screen layer is effectively arranged in the cassette.

28. A method as claimed in claim 27 wherein the subject for imaging is selectively a human, and wherein an area for imaging is selectively the temporamandibular joint.

29. A method of recording images of a subject comprising of passing a radiation beam through a subject and recording the beam, the beam having passed through the subject, onto a film, the film being in layered relationship with a screen layer having areas of different reactance, and a filter layer, and the filter layer having different spectral responses over its area thereby, through the interaction of the screen layer, filter layer and radiation beam, acting to regulate the image recorded on the film.

30. A method as claimed in claim 29 wherein the different spectral responses are caused by different optical densities, the densities being related to the subject for radiation with the subject for imaging being relatively aligned with the film and the filter layer so that a predetermined image of the subject is obtained on the film, the image being coordinated with the different areas of the selected densities of the filter layer.

31. A radiography apparatus having in overlapping relationship so as to define an area for exposure to a radiation beam, the apparatus comprising:

multiple screen layers, at least one screen layer having areas of different reactance, a radiation recording element for recording a radiation image caused by a beam directed to a subject, and multiple filter layers, at least one the filter layers having an area of first optical density and an area of second optical density, the filter layers being for regulating the effect of the exposure of the screen layers to a radiation beam over a selected area of the screen layers and the radiation recording element.

32. A radiography apparatus as claimed in claim 1 wherein the filter layer effects filtering through at least one of an electronic or chemical effect.

33. A radiography apparatus as claimed in claim 1 wherein the radiation recording element includes at least one of digital or chemical recording elements.

* * * * *

UNITED STATES PATENT AND TRADEMARK OFFICE

CERTIFICATE OF CORRECTION

PATENT NO. : 5,734,693

DATED : March 31, 1998

INVENTOR(S) : Arthur S. Quint, et al.

It is certified that error appears in the above-identified patent and that said Letters Patent is hereby corrected as shown below:

At column 4, line 52, please replace "Potion" with —Porion—.

At column 8, line 46, please insert —of— after "one".

Signed and Sealed this

Twenty-third Day of March, 1999

*Attest:*

Q. TODD DICKINSON

*Attesting Officer*

*Acting Commissioner of Patents and Trademarks*